United States Patent [19]

Müller

[11] Patent Number: 4,681,076

[45] Date of Patent: Jul. 21, 1987

[54] ELECTRONICALLY CONTROLLED FUEL INJECTION SYSTEM FOR AN INTERNAL COMBUSTION ENGINE

[75] Inventor: Hans-Martin Müller, Oberriexingen, Fed. Rep. of Germany

[73] Assignee: Robert Bosch GmbH, Stuttgart, Fed. Rep. of Germany

[21] Appl. No.: 809,012

[22] Filed: Dec. 13, 1985

[30] Foreign Application Priority Data

Dec. 13, 1984 [DE] Fed. Rep. of Germany ..... 3445414

[51] Int. Cl.[4] ..... F02D 41/04

[52] U.S. Cl. ..... 123/488; 123/478

[58] Field of Search ..... 123/478, 480, 494, 488

[56] References Cited

U.S. PATENT DOCUMENTS 4,406,266 9/1983 Kiesling ..... 123/478

4,480,620 11/1984 Tange et al. ..... 123/478

4,643,153 2/1987 Clement et al. ..... 123/478

FOREIGN PATENT DOCUMENTS 58-180734 10/1983 Japan ..... 123/478

*Primary Examiner*—Andrew M. Dolinar

*Attorney, Agent, or Firm*—Walter Ottesen

[57] ABSTRACT

The invention relates to an electronically controlled fuel injection system for an internal combustion engine wherein all dependency on the supply voltage for the electro-hydraulic components is compensated for and/or the pressure-regulator characteristic dependent upon the pumped quantity is compensated for. With respect to the dependency of the electric fuel pump on the supply voltage, this is accomplished by means of a correction factor for the basic injection signal. Below a specific voltage value which corresponds to the voltage required for maintaining the system pressure, this correction factor becomes progressively larger. The pressure regulator characteristic dependent upon the quantity of fuel pumped is taken into account in the correction in a corresponding manner.

5 Claims, 5 Drawing Figures

ELECTRONICALLY CONTROLLED FUEL INJECTION SYSTEM FOR AN INTERNAL COMBUSTION ENGINE

FIELD OF THE INVENTION

The invention relates to an electronically controlled fuel injection system for an internal combustion engine. The system includes an electrically driven fuel pump, at least one magnetic valve for metering the fuel and signal formation means for forming fuel injection signals in dependence upon operating characteristic quantities such as load and rotational speed.

BACKGROUND OF THE INVENTION

A fuel-injection apparatus with a correction function for the supply voltage is known from German published patent application DE-OS No. 15 26 506. On page 34 of this application, it is stated that fluctuations in the supply voltage affect the fuel-injection apparatus because at a higher voltage the injection valves open more quickly than at a lower voltage.

Also, German published and examined patent application DE-AS No. 22 65 224 discloses an electrically controlled fuel-injection apparatus for an internal combustion engine with a control multivibrator and wherein there is a correction for electric voltage. Also in this application, only the dependence of the injection valves on the voltage is stated as the reason for providing this voltage correction function.

SUMMARY OF THE INVENTION

It has been shown, however, that the known injection apparatus do not yet operate optimally in every case with regard to the dependence on the operating voltage. Accordingly, it is one of the objects of the invention to completely eliminate the dependence of injection upon the battery voltage and thus achieve optimum results.

The fuel injection system of the invention ensures that all components which are dependent on operating voltage or pumped quantity are taken into consideration thereby eliminating an adverse effect on the accuracy of fuel metering in dependence upon the supply voltage of the individual components.

Further advantages and embodiments of the invention will become apparent from the subsequent description in conjunction with the drawing and from the claims.

BRIEF DESCRIPTION OF THE DRAWING

An embodiment of the invention will now be described in more detail with reference to the drawing wherein.

DESCRIPTION OF THE PREFERRED EMBODIMENT OF THE INVENTION

Figure 1:
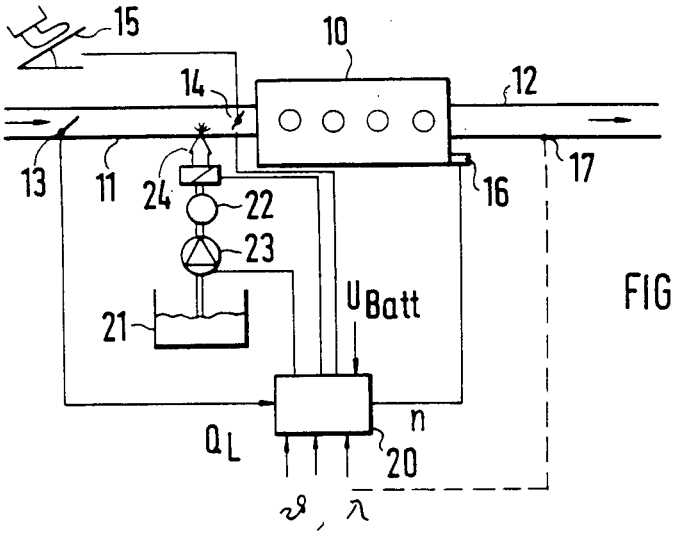
FIG. 1 is a schematic of a fuel injection system.

FIG. 1 is a schematic of a fuel injection apparatus for an internal combustion engine. Reference numeral 10 identifies the internal combustion engine which has an air intake pipe 11 and an exhaust pipe 12. An air-flow rate sensor 13 is mounted in the intake pipe 11 and represents in principle a load sensor. It is understood that, for example, a pressure sensor inserted downstream of a throttle valve 14 or an apparatus controlled by throttle valve angle or by rotational speed may be substituted for the flap-type air-quantity sensor illustrated symbolically. The throttle valve 14 is actuated via an accelerator pedal 15. The internal combustion engine 10 also has a rotational-speed sensor 16 and reference numeral 17 identifies an exhaust-gas sensor which can be used as may be required. The sensor 17 is shown mounted in the exhaust pipe 12.

A control unit 20 providing a fuel-injection signal receives as main input quantities signals indicative of the rotational speed from rotational-speed sensor 16 as well as signals indicative of the load from the air-flow sensor 13 or from the throttle valve 14. In addition, the control unit 20 has further inputs for the following: temperature, a Lambda value if the exhaust-gas sensor 17 is used; and, where applicable, the position of the throttle valve 14. Moreover, the battery voltage $U_{Batt}$ is also applied to the control unit. On the one hand, the battery voltage $U_{Batt}$ serves as the supply voltage and, on the other hand, as a quantity to be sensed in connection with the voltage correction function.

FIG. 1 also shows a fuel tank 21, a pressure regulator 22 and an electromagnetically actuable fuel-injection valve 24 communicating with the air intake pipe 11 of the internal combustion engine 10. It is emphasized that the sequential arrangement of air-flow sensor, injection valve and throttle flap in the air flow of the intake pipe 11 need not necessarily correspond to the sequence indicated, but other sequential arrangements are also customary. Thus, for example, the fuel injection may also take place more or less directly downstream of the throttle flap 14.

Finally, an electrically operated fuel-metering pump 23 is arranged between the fuel tank 21 and the pressure regulator 22.

The arrangement of an electrically controlled or regulated fuel-injection system as shown in FIG. 1 is known per se. The computerized control systems which are increasingly used in connection with gasoline injection generally operate in accordance with the schematic flowchart of FIG. 2. After startup of the system (at 25), the individual parameters are read in (26). This is followed by the determination of the basic duration of injection (27). This basic duration of injection is influenced by correction factors depending upon the operating condition. Finally, the injection signal is read out (29) thereby causing the injection operation to be performed. This terminates an individual operation (30).

Figure 2:
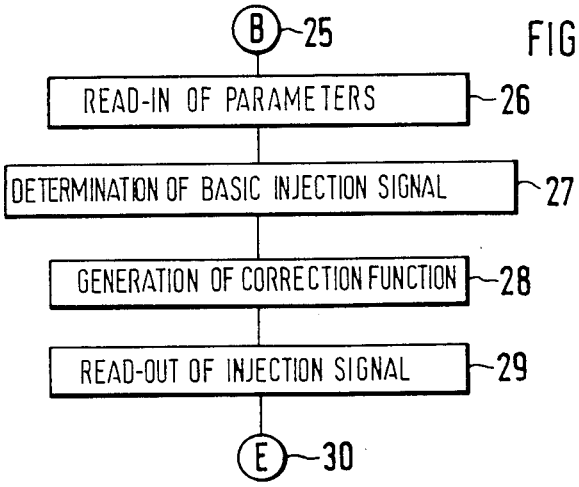
FIG. 2 is a schematic flowchart for determining the injection signals.

It is understood that the performance of the individual operations may be highly complex in a computer-controlled unit as well as an analog functioning unit for gasoline injection. The basic configuration of signal processing remains, however, unchanged to the extent that, on the basis of the principal operating characteristic quantities, a basic duration of injection is formed at least as their signal which may be subsequently corrected on a case-by-case basis. In view of this background, the illustration of FIG. 2 is thus state of the art.

The actual invention begins with the generation of the correction signals. With respect to the voltage correction, these signals may be of a both additive and multiplicative nature. As a rule, the battery-voltage correction is additive with respect to the injection valves. In accordance with the invention, the correction signals are joined by another quantity which is a correction factor for the dependence of the fuel pump on the supply voltage.

Figure 3:
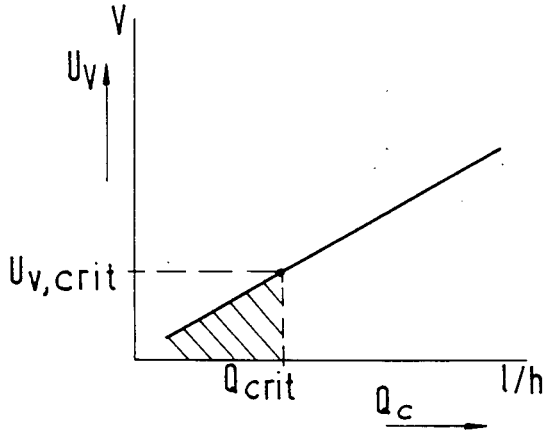
FIG. 3 is a plot of the fuel metering rate in dependence upon the supply voltage of an electrically operated fuel pump.
Figure 4:
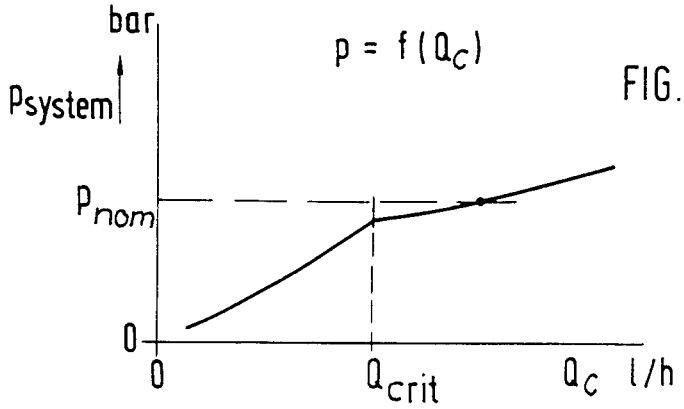
FIG. 4 is a pressure-regulator characteristic as a function of the fuel metering rate; and, FIG. 5 is a plot of a correction factor for the injection signals in dependence upon the supply voltage, taking into consideration the supply-voltage-dependent pumped fuel quantity of the fuel pump and the dependence of the pressure-regulator characteristic on the pumped fuel quantity.

FIG. 3 shows the relationship between the metered fuel quantity $Q_c$ in liters per hour and the supply voltage for the fuel pump in volts. If, as a result of a low supply voltage, the quantity of fuel metered drops below a critical metered quantity $Q_{crit}$, the predetermined system pressure can no longer be maintained. Consequently, the quantity of fuel metered by the injection valve becomes less. In addition, there is the requirement, appearing from FIG. 4, to make a specific metered quantity available for maintaining the system pressure. According to FIG. 4, the system pressure ($P_{system}$) decreases considerably below the critical metering quantity $Q_{crit}$.

Figure 5:
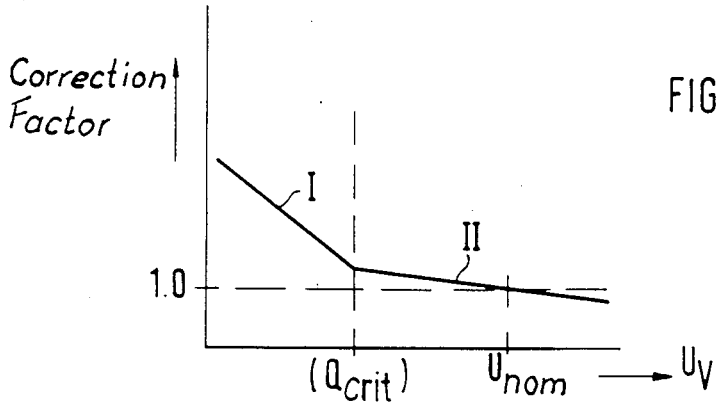

In order to compensate for the decrease in the quantity of fuel injected, the duration of injection is extended in dependence on the supply voltage, such that the quantity then delivered corresponds again to the desired value. A correction factor is generated for this purpose which is plotted against the supply voltage in FIG. 5. As shown in FIG. 5, a correction factor greater than unity occurs at very low supply voltages. With the supply voltage in the range on the nominal voltage, the correction factor will be reduced to unity and can drop to below unity at higher supply voltages. In FIG. 5, numeral I identifies the range in which the pressure regulator is not activated, while numeral II marks the range in which the pressure regulator is active.

Thus, the invention permits the compensation of all dependences on the supply voltage in the hydraulic area and the accomplishment of optimum results with regard to the accurate metering of fuel.

It is understood that the foregoing description is that of the preferred embodiments of the invention and that various changes and modifications may be made thereto without departing from the spirit and scope of the invention as defined in the appended claims.

What is claimed is:

1. An electronically controlled fuel injection system for an internal combustion engine comprising:

at least one solenoid valve for metering fuel to the engine;

an electrically-operated fuel pump for pumping fuel to said solenoid valve;

supply voltage means for supplying a supply voltage to said solenoid valve and said fuel pump;

signal generating means for generating fuel injection signals in dependence upon operating characteristic quantities such as load and rotational speed, said fuel injection signals being determinative of the duration of injection;

said signal generating means including means for effecting a correction of said fuel injection signals with reference to the dependency of said solenoid valve on said supply voltage;

a pressure regulator for regulating the pressure of the fuel pumped by said pump to said solenoid valve when said pressure is above a predetermined value; and, said signal generating means further including means for generating a correction signal related to the quantity of fuel pumped by said fuel pump with respect to the supply voltage, the reaction of said pressure regulator when the pressure of said fuel drops below said predetermined value, and the pressure of the fuel at said solenoid valve as a further correction of said fuel injection signals as a function of said supply voltage so as to adjust said duration of injection to ensure that the quantity of fuel metered to the engine is adequate to maintain the required amount of fuel according to said operating characteristic quantities.

2. The electronically controlled fuel injection system of claim 1, comprising means for causing said last-mentioned correction to operate multiplicatively.

3. The electronically controlled fuel injection system of claim 1, said pressure regulator having a pressure-regulator characteristic; said signal generating means including means for considering the pressure-regulator characteristic as a correction quantity.

4. The electronically controlled fuel injection system of claim 3, said signal generating means further including means for causing the dependency of the pressure-regulator characteristic on the quantity of the pumped fuel to operate multiplicatively.

5. The electronically controlled fuel injection system of claim 4, wherein the correction factor above a supply voltage value, whereat the fuel pump can deliver the system pressure, is at the quantity equal to or less than unity and beneath said voltage value, said quantity is at increasingly higher values.

* * * * *